US007387713B2

(12) United States Patent
Marcelino et al.

(10) Patent No.: US 7,387,713 B2
(45) Date of Patent: Jun. 17, 2008

(54) RESISTORED ANODE CONSTRUCTION

(75) Inventors: Ronald D. Marcelino, Montgomery, AL (US); James S. Roden, Montgomery, AL (US)

(73) Assignee: Rheem Manufacturing Company, New York, NY (US)

( * ) Notice: Subject to any disclaimer, the term of this patent is extended or adjusted under 35 U.S.C. 154(b) by 338 days.

(21) Appl. No.: 11/295,813

(22) Filed: Dec. 7, 2005

(65) Prior Publication Data

US 2007/0125640 A1 Jun. 7, 2007

(51) Int. Cl.
*C23F 13/10* (2006.01)

(52) U.S. Cl. ..... 204/196.11; 204/196.26; 204/196.36; 204/196.37; 204/279; 204/280; 126/377.1; 392/457

(58) Field of Classification Search ..... 204/196.11, 204/196.26, 279, 280, 196.36, 196.37; 126/377.1; 392/457

See application file for complete search history.

(56) References Cited

U.S. PATENT DOCUMENTS 2,568,594 A 9/1951 Robinson
2,740,757 A 4/1956 Craver
2,934,485 A 4/1960 Sabins
4,093,529 A 6/1978 Strobach
4,381,981 A 5/1983 Maes
4,786,383 A 11/1988 Houle
4,848,616 A 7/1989 Nozaki
4,972,066 A 11/1990 Houle et al.
5,023,928 A 6/1991 Houle et al.
5,256,267 A * 10/1993 Roden ..... 204/196.11
5,334,299 A * 8/1994 Roden ..... 204/196.11
5,335,311 A 8/1994 Groothuizen
6,019,877 A 2/2000 Dupelle et al.

* cited by examiner

*Primary Examiner*—Bruce F Bell
(74) *Attorney, Agent, or Firm*—Haynes and Boone, LLP

(57) ABSTRACT

A sacrificial anode assembly operative to inhibit corrosion in the metal tank portion of a water heater includes a cylindrical metal anode member having an end retained within a tubular, electrically non-conductive plastic insulating sleeve which, in turn, is captives retained within a metal cap portion of the assembly. A resistor is received in an end surface groove of the sleeve and has a lead wire spot-welded or soldered to a core wire portion of the anode member. To prevent contact between the lead wire and the metal cap, and to protect the lead wire against vibration caused breakage at its spot weld or solder area, a U-shaped central portion of the lead wire is received in a through-opening in the resistor-supporting end of the sleeve which is covered by an annular insulating wafer formed from an electrically non-conductive material.

20 Claims, 2 Drawing Sheets

RESISTORED ANODE CONSTRUCTION

BACKGROUND OF THE INVENTION

The present invention generally relates to anode devices used to inhibit corrosion in metal water heater tanks and other metal liquid storage vessels and, in a preferred embodiment thereof, more particularly relates to a specially designed resistored anode assembly useful in this corrosion-inhibiting application.

Conventional metal water heater tanks, like other types of metal vessels used to store liquids, are subject to corrosion during use. To inhibit this corrosion, sacrificial anodes, normally constructed of magnesium, aluminum or zinc, are inserted into the tank. The sacrificial anode is slowly consumed during the corrosion protection process while generating an electrical current. AS the anode is slowly depleted, its simultaneously generated electrical current catholically protects the tank against corrosion.

The service life of the anode tends to be inversely dependent upon the amount of electrical current it generates in cathodically protecting the tank. In many fresh water supplies, particularly those having a high mineral content, the current flow generated by the anode is relatively high, resulting in a corresponding decrease in the useful life of the anode. In order to control the rate of consumption of a sacrificial anode, various anode constructions have been previously proposed in which a resistor is incorporated in the anode, and electrically connected between the anode and its protected tank, to automatically regulate the electrical current generated by the anode during its operation and thereby increase the service life of the anode.

While these resistored anode devices typically extended anode life, many of them also tended to be of a relatively complex construction, rather difficult to assemble, and relatively expensive to fabricate.

Many of these problems were essentially eliminated by a prior art sacrificial anode assembly that incorporated, in a simplified manner, an ordinary barrel-type carbon resistor into the interior of the assembly. This prior art anode assembly included a cylindrical plastic insulating sleeve captively retained within a metal cap portion of the anode assembly and having a closed end with a central opening through which an end portion of the metal anode body core rod extended. A diametrically extending groove, which intersected the central sleeve opening, was formed in the closed sleeve end.

The cylindrical resistor body was disposed in a radial portion of the sleeve end groove, with one of the resistor end leads being radially extended over the anode rod end and soldered or welded thereto. The other resistor end surface groove in the insulating sleeve end passed through an axially extending exterior side surface groove in the insulating sleeve and was soldered or welded at its outer end to an external metal cap portion of the anode assembly.

Although this method of operatively positioning a resistor in a sacrificial anode assembly provided a worthwhile reduction in assembly time and cost, and provided the desired regulation of anode current generation, it was found that it could create a problem relating to the structural integrity of the completed anode assembly. Specifically, it was found that in certain shipping orientations of the tank in which the anode assembly was installed, harmonic vibration might be created within the central anode core rod which were transmitted to the solder or weld joint connecting a resistor end lead to the rod. These vibrations could fatigue and break the rod/lead solder or weld joint, thereby rendering the anode assembly inoperative.

This vibration-created breakage of the rod/lead solder or weld joint was substantially eliminated by the anode assembly improvements incorporated in this type of anode assembly as illustrated and described in U.S. Pat. Nos. 5,256,267 and 5,334,299, each of such patents having been assigned to the assignee of the present invention. Such patents are hereby incorporated by reference herein in their entireties. The improvements illustrated and described in these patents comprise replacing the axial cap end groove with a generally U-shaped surface groove, forming a generally U-shaped bend in the resistor lead to be soldered to the anode core rod, placing the U-shaped bend portion of the resistor lead into the U-shaped surface groove, and then soldering or welding the outer end of the resistor lead to the anode core rod. This configuration and placement of the soldered or welded resistor lead extending along the closed plastic sleeve end provided the lead with a flexure capability that substantially eliminated vibration-caused breakage thereof at the lead/rod solder or weld joint.

However, a problem with this constructional approach was subsequently discovered. Specifically, during electrically conductive connection of the resistor lead to the anode rod (as by soldering or welding) the lead could be forcibly engaged with the bottom side of its associated sleeve groove and deflected outwardly therefrom in a manner such that when the sleeve was subsequently pressed into the metal cap of the overall anode assembly, the deflected lead could contact and electrically short out against the metal cap.

A means to prevent this undesirable electrically shorting effect was implemented by the manufacturer of the anode assembly by using a drop of an ultra violet light-cured adhesive onto the lead and the plastic sleeve. This gave a firm immediate bond of the lead wire to the plastic sleeve, thereby preventing movement of the lead wire during the lead wire/anode rod welding or soldering process. Examination of field failures indicated that this corrective procedure reintroduced the stress on the lead wire that had previously been relieved by the generally U-shaped bend in the lead wire. If there was any movement of the sleeve on the anode or movement of the anode within the sleeve, a substantial stress was placed on the lead wire adjacent the lead wire/anode rod weld or solder joint. This same phenomenon was encountered if the plastic sleeve absorbed water causing the plastic to swell in a manner forcibly moving the lead wire and causing breakage thereof, thereby rendering the anode assembly ineffective in providing corrosion to its associated tank.

As can be seen from the foregoing, a need exists for a solution to these constructional problems presented in a protective anode assembly of the type described above. It is to this need that the present invention is directed.

SUMMARY OF THE INVENTION

In carrying out principles of the present invention, in accordance with a preferred embodiment thereof, a specially designed resistored sacrificial anode assembly is provided for use in a metal liquid storage vessel, such as a water heater tank, to inhibit vessel corrosion.

The anode assembly may be secured to the vessel, to extend into its liquid filled interior, and representatively includes a sacrificial anode member having a core portion extending therethrough, and an electrically non-conductive insulating sleeve member illustratively formed from a plastic material and receiving a portion of the anode member, the sleeve member having an end wall section with a through-opening therein. A hollow metal cap receives the end wall section of the sleeve member, and the assembly further includes an electrical resistor having a body portion supported on the end wall section of the sleeve member and a lead wire conductively anchored, illustratively by soldering or spot welding, to the core portion and having a curved stress relieving portion, representatively having a generally U-shaped configuration, received in the through-opening.

The receipt of the stress relieving portion of the lead wire in the sleeve end wall through-opening inhibits this portion of the lead wire from being deflected outwardly away from the sleeve end wall during the soldering or spot welding process, or thereafter, and contacting and shorting out against the metal cap when the sleeve is subsequently inserted into the metal cap.

Preferably the insulating sleeve member has a side wall section perpendicular to its end wall section and having an exterior side surface groove which extends perpendicularly to the end wall section. A second lead wire portion of the electrical resistor extends through this side surface groove.

According to another aspect of the invention, the sacrificial anode assembly further comprises an electrically insulative member which is interposed between the insulating sleeve member end wall section and the metal cap and extending over the through-opening in the end wall section of the sleeve member. The electrically insulative member functions as an insulative barrier to prevent contact between the stress relieving curved portion of the resistor lead wire and the metal cap even if such lead wire portion is somehow deflected outwardly away from the end wall section of the sleeve member. Preferably, the electrically insulative member is of a plastic material and is of an annular wafer-shaped configuration, with the insulative member having a central opening that overlies and exposes the anode core/resistor lead wire solder or spot weld area.

DETAILED DESCRIPTION

Figure 1:
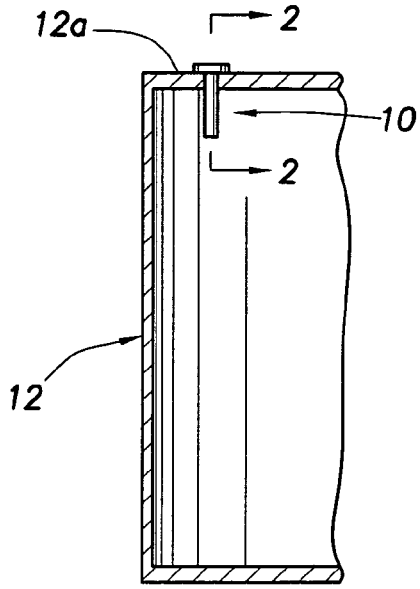
FIG. 1 is a schematic partial cross-sectional view through a representative metal water heater tank having operatively installed on a top end thereof a resistored sacrificial anode assembly embodying principles of the present invention.

Referring to FIGS. 1-4, the present invention provides a specially designed resistored sacrificial anode assembly 10 which is similar to, but provides substantial improvements over, the sacrificial anode assembly illustrated and described in U.S. Pat. Nos. 5,256,267 and 5,334,299 which have been incorporated by reference herein in their entireties.

The resistored sacrificial anode assembly 10 is operatively installed in the top end wall 12*a* of a representative metal water heater storage tank 12, extends into the water-filled interior of the tank, and operates to cathodically inhibit corrosion of the tank. As cross-sectionally illustrated in FIG. 2, the anode assembly 10 includes a cylindrically shaped sacrificial anode member 14 having a main body portion 16, a reduced diameter neck portion 18 having an annular external side surface indentation 20 formed therein, and an annular ledge 22 formed at the juncture of the main body and neck portions 16,18. Axially extending centrally through the anode member 14 is a metal core wire or rod 24 having an upper end portion 24*a* extending upwardly beyond the upper end of the neck portion 18.

The anode member neck portion 18 is coaxially pressed into the open lower end 26 of a cylindrical, electrically non-conductive molded plastic insulating sleeve 28 having a top end wall 30 through which a central circular hole 32 is formed. When the anode neck 18 is pressed into sleeve 28, the core wire end portion 24*a* is received in the hole 32. As will be readily appreciated by those of skill in this particular art, sleeve 18 could be alternately formed from an electrically insulative material other than plastic if desired.

Figure 2:
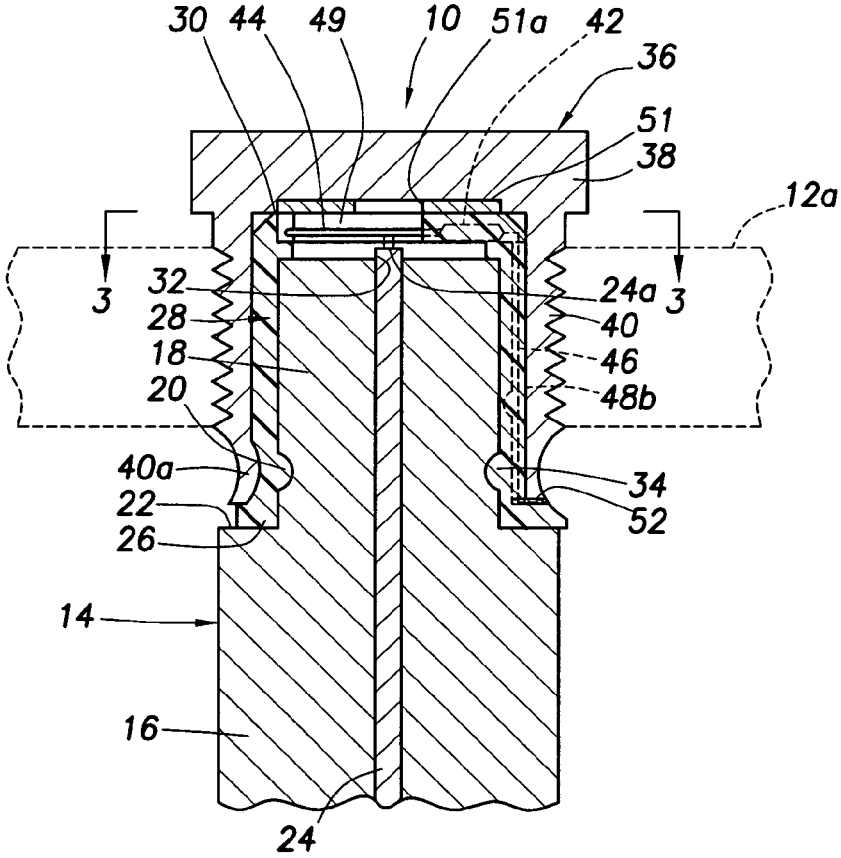
FIG. 2 is an enlarged scale partial cross-sectional view through the anode assembly taken along line 2-2 of FIG. 1.
Figure 3:
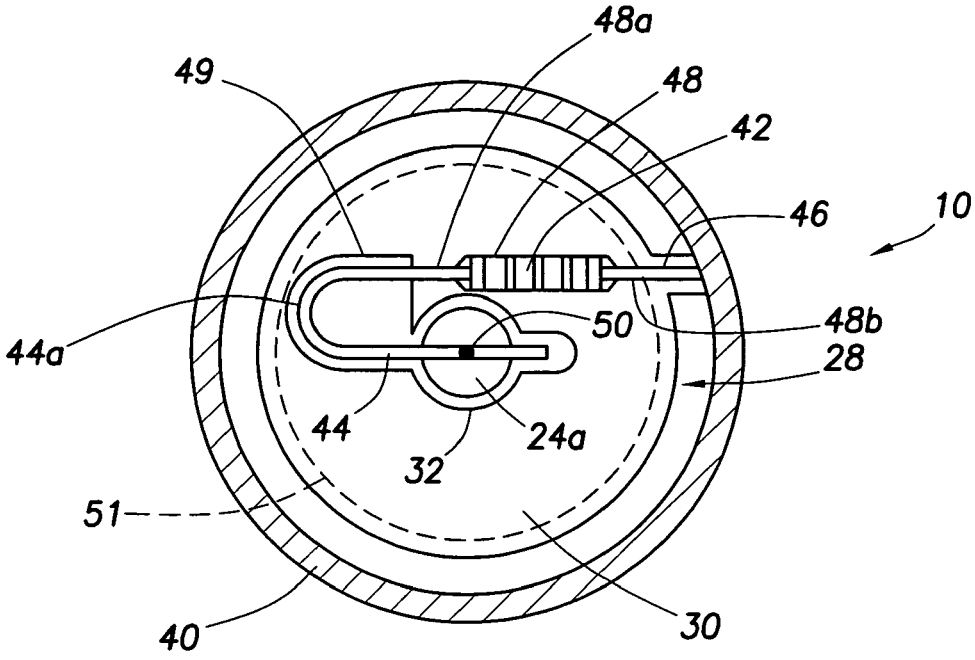
FIG. 3 is an enlarged scale, partially phantomed cross-sectional view through the anode assembly taken along line 3-3 of FIG. 2.

Sleeve 28, in turn, is pressed into a hollow cylindrical metal cap member 36 having an enlarged diameter head portion 38, and a hollow externally threaded body portion 40 threaded into the top tank end wall 12*a* as shown in FIG. 2. A lower end portion 40*a* of the body portion 40 is inwardly swaged against the body of the plastic sleeve 28 to captively retain the sleeve 28 within the cap member body 40. This swaging also forces an annular portion 34 of the sleeve 28 into the annular groove 20.

To control and maintain the protective anode current at a suitable level, the anode assembly 10 is provided with a barrel-shaped resistor 42 (see FIGS. 2 and 3) having metal lead wires 44 and 46 extending outwardly from its opposite ends. To support the resistor 42 on the top end wall 30 of the sleeve 28, the body of the resistor 42 is snap-fitted into a top surface groove 48 formed in the sleeve end wall 30, with inner longitudinal portion of the resistor leads 44,46 being respectively received in narrowed opposite end portions 48*a*,48*b* of the surface groove 48. For purposes later described herein, the groove portion 48*b* is extended vertically down an exterior side surface portion of the sleeve 28 (see FIG. 4).

According to a feature of the present invention, a through-opening 49 (see FIGS. 2 and 3) extends through the top sleeve end wall 30, completely between its top and bottom side surfaces, and receives a generally U-shaped longitudinally intermediate, stress-relieving bend portion 44*a* of the resistor wire 44. According to another feature of the present invention, the resistored anode assembly 10 also includes an electrically insulative annular wafer 51 (see FIGS. 2-4) having a central circular hole 51*a* therein. Wafer 51 is suitably secured to the top side of the upper end wall 30 of the plastic insulating sleeve 28 (as by a suitable adhesive material), over the resistor 42 and its lead wire portions extending parallel to the end wall 30, with the central wafer opening 51*a* overlying the central opening 32 in the top sleeve end wall 30 and exposing an outer end portion of the resistor lead wire 44 (see FIG. 4).

Figure 4:
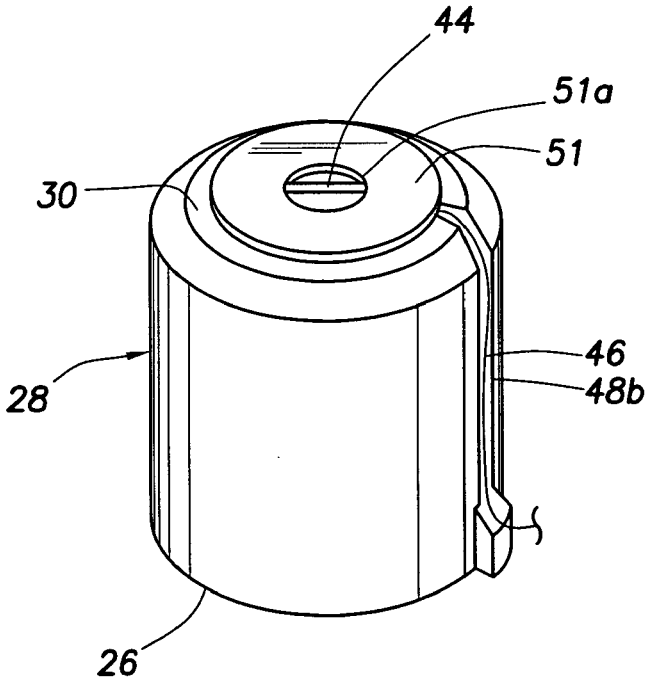
FIG. 4 is a perspective view of an internal plastic insulating sleeve portion of the anode assembly and an associated annular insulating wafer used in the assembly.

Prior to the insertion of the sleeve 28 within the body portion 40 of the cap member 36, the resistor 42 is snap-fitted into the top end groove 48 of the sleeve 28, the U-shaped portion 44*a* of the resistor lead 44 is positioned in the upper sleeve end through-opening 49, an outer end portion of the lead 44 is spot welded, soldered, or otherwise conductively secured to the upper core wire end portion 24*a*, as at 50 (see FIG. 3), an outer end portion of the resistor lead 46 is extended downwardly through the exterior vertical portion of the groove 48*b*, and the annular insulative wafer 51 is secured in place atop the upper end wall 30 of the sleeve 28 as shown in FIG. 4. Other suitable shapes for this electrically insulative member 51 could alternatively be utilized if desired.

With the insulated annular wafer 51 secured in place atop the sleeve end wall 30, the anode member-supported sleeve 28 is then operatively inserted into the body 40 of the cap member 36. The completed anode assembly 10 is then ready to be threaded into the tank wall 12*a* as illustrated in FIG. 2.

The resilience of the generally U-shaped stress relieving portion 44*a* of the resistor lead 44 received in the sleeve through-opening 49 protects the lead 44 from breaking at the spot weld or solder area 50 due to vibrational or other forces. Additionally, the unique provision of the through-opening 49 (within which the U-shaped portion 44*a* of the lead wire 44 is disposed before the lead wire/core wire spot weld or solder area 50 is formed) substantially inhibits the U-shaped lead wire portion 44*a* from being bent upwardly beyond the sleeve end wall 30 during the spot welding or soldering process since there is no portion of the sleeve end wall 30 that underlies and can exert an upward deflection force on the lead wire portion

44*a*. Further, due to the unique provision of the sleeve through-opening 49, moisture-caused upward expansion of the sleeve end wall 30 also does not tend to upwardly deflect the U-shaped lead wire portion 44*a* upwardly beyond the sleeve end wall 30. Additionally, the installed insulative wafer 51 (representatively of a thin plastic construction) acts as an insulative barrier that prevents contact between the lead wire 44 and the metal cap 36 even if for some reason the lead wire portion 44*a* was somehow subjected to an upwardly directed deflecting force during the assembly process or otherwise.

The foregoing detailed description is to be clearly understood as being given by way of illustration and example only, the spirit and scope of the present invention being limited solely by the appended claims.

What is claimed is:

1. A sacrificial anode assembly comprising:

a sacrificial anode member having a core portion extending therethrough;

an electrically non-conductive insulating sleeve member receiving a portion of said anode member and having an end wall section with a through-opening therein;

a hollow metal cap receiving said end wall section of said sleeve member; and an electrical resistor having a body portion supported on said end wall section of said sleeve member and a lead wire conductively anchored to said core portion and having a curved stress relieving portion received in said through-opening.

2. The sacrificial anode assembly of claim 1 wherein:

said lead wire is spot welded or soldered to said core portion of said anode member.

3. The sacrificial anode assembly of claim 1 wherein:

said insulating sleeve member is of a plastic construction.

4. The sacrificial anode assembly of claim 1 wherein:

said stress-relieving portion of said lead wire has a generally U-shaped configuration.

5. The sacrificial anode assembly of claim 1 wherein:

said insulating sleeve member has a side wall section perpendicular to said end wall section and having an exterior side surface groove thereon which extends perpendicularly to said end wall section, said lead wire is a first lead wire, and said electrical resistor has a second lead wire which extends through said exterior side surface groove.

6. The sacrificial anode assembly of claim 1 wherein:

said end wall section of said insulating sleeve member has an exterior surface groove into which said body portion of said electrical resistor is recessed, said exterior surface groove communicating with said through-opening that receives said curved stress relieving portion of said lead wire.

7. The sacrificial anode assembly of claim 1 further comprising:

an electrically insulative member interposed between said insulating sleeve member end wall section and said metal cap and extending over said through-opening in said end wall section.

8. The sacrificial anode assembly of claim 7 wherein:

said electrically insulative member is of a plastic material.

9. The sacrificial anode assembly of claim 7 wherein:

said electrically insulative member is of an annular wafer-shaped configuration.

10. The sacrificial anode assembly of claim 1 in combination with a water heater having a water storage tank portion, said sacrificial anode assembly operatively extending into the interior of said water storage tank portion.

11. The sacrificial anode assembly of claim 7 in combination with a water heater having a water storage tank portion, said sacrificial anode assembly operatively extending into the interior of said water storage tank portion.

12. An insulating sleeve for use in a resistored sacrificial anode assembly, said insulating sleeve having:

a hollow, electrically non-conductive cylindrical body portion having an open first end, a second end across which an end wall extends, and a side wall extending transversely to said end wall, said end wall having a central opening extending therethrough, a first exterior surface groove spaced apart from said central opening and configured to receive a body portion of an electrical resistor, and a through-opening, said first exterior surface groove and said central opening communicating with one another via said through-opening, and said side wall having a second exterior surface groove extending generally transversely to said end wall and defining an extension of said first exterior surface groove.

13. The insulating sleeve of claim 12 wherein:

said insulating sleeve is of a plastic material.

14. The insulating sleeve of claim 12 wherein:

said through-opening is substantially larger than said central opening.

15. A sacrificial anode assembly comprising:

a sacrificial anode member having a core portion extending therethrough, said core portion having an end section;

an electrically non-conductive insulating sleeve member receiving a portion of said anode member and having an end wall with a central opening formed therein and overlying said end section of said core portion of said anode member;

a hollow metal cap receiving said end wall of said insulating sleeve member;

an electrical resistor carried by said end wall of said insulating sleeve member, and having a lead wire conductively anchored to said core portion of said anode member, said lead wire having a curved stress relieving section formed therein; and an electrically insulative member interposed between said curved stress relieving section of said lead wire and a facing portion of said hollow metal cap.

16. The sacrificial anode assembly of claim 15 wherein:

said lead wire is spot welded or soldered to said core portion of said anode member.

17. The sacrificial anode assembly of claim 15 wherein:

said electrically insulative member is of a plastic material.

18. The sacrificial anode assembly of claim 15 wherein:

said electrically insulative member is of an annular wafer-shaped configuration having a central opening overlying said central opening in said end wall of said insulating sleeve member.

19. The sacrificial anode assembly of claim 15 in combination with a water heater having a water storage tank portion, said sacrificial anode assembly operatively extending into the interior of said water storage tank portion.

20. The sacrificial anode assembly of claim 18 in combination with a water heater having a water storage tank portion, said sacrificial anode assembly operatively extending into the interior of said water storage tank portion.

* * * * *